United States Patent [19]

Knutson

[11] Patent Number: 5,040,955

[45] Date of Patent: Aug. 20, 1991

[54] PERISTALTIC PUMP HAVING INFLATABLE PUMPING MEMBERS

[75] Inventor: Roger L. Knutson, Plymouth, Minn.

[73] Assignee: Honeywell Inc., Minneapolis, Minn.

[21] Appl. No.: 541,238

[22] Filed: Jun. 20, 1990

[51] Int. Cl.[5] ..... F04B 43/12

[52] U.S. Cl. ..... 417/474; 604/153

[58] Field of Search ..... 417/474, 475, 478, 479; 604/153

[56] References Cited

U.S. PATENT DOCUMENTS

| | | | |
|---|---|---|---|
| 2,926,614 | 3/1960 | Rose, Jr. | 417/474 X |
| 3,560,114 | 2/1971 | Boyle | 417/474 X |
| 3,877,838 | 4/1975 | Choy | 417/474 X |

*Primary Examiner*—Leonard E. Smith
*Assistant Examiner*—Eugene L. Szczecina, Jr.
*Attorney, Agent, or Firm*—Whitham & Marhoefer

[57] ABSTRACT

A peristaltic pump has a series of inflatable members which serve to sequentially restrict a fluid passage in order to provide the pumping action. The fluid passageway is a closed passage as for example a tube. However in certain applications the principles of this invention may be applicable to an open passage such as a trough. In one embodiment, a series of inflatable toroidal members are mounted on a tube that has a flexible wall. When sequentially inflated, the toroidal members sequentially squeeze the wall into engagement with a centrally disposed mandrel, thusly, providing a peristaltic pumping action.

2 Claims, 4 Drawing Sheets

| TIME STEP | MEMBER NUMBER | | | | | | | | |
|---|---|---|---|---|---|---|---|---|---|
| | 1 | 2 | 3 | 4 | 5 | 6 | 7 | 8 | 9 |
| 1 | X | | X | X | | X | X | | X |
| 2 | X | X | | X | X | | X | X | |
| 3 | | X | X | | X | X | | X | X |
| 4 | X | | X | X | | X | X | | X |
| 5 | X | X | | X | X | | X | X | |
| 6 | | X | X | | X | X | | X | X |
| 7 | X | | X | X | | X | X | | X |
| 8 | X | X | | X | X | | X | X | |
| 9 | | X | X | | X | X | | X | X |

FLOW TO THE RIGHT LOW VOLUME

| | | | | | | | | | |
|---|---|---|---|---|---|---|---|---|---|
| 1 | X | | X | X | | X | X | | X |
| 2 | | X | X | | X | X | | X | X |
| 3 | X | X | | X | X | | X | X | |
| 4 | X | | X | X | | X | X | | X |
| 5 | | X | X | | X | X | | X | X |
| 6 | X | X | | X | X | | X | X | |
| 7 | X | | X | X | | X | X | | X |
| 8 | | X | X | | X | X | | X | X |
| 9 | X | X | | X | X | | X | X | |
| 10 | | | | | | | | | |

FLOW TO THE LEFT

| | | | | | | | | | |
|---|---|---|---|---|---|---|---|---|---|
| 1 | X | | | | X | X | | | |
| 2 | X | X | | | | X | X | | |
| 3 | | X | X | | | | X | X | |
| 4 | | | X | X | | | | X | X |
| 5 | | | | X | X | | | | X |
| 6 | X | | | | X | X | | | |
| 7 | X | X | | | | X | X | | |
| 8 | | X | X | | | | X | X | |
| 9 | | | X | X | | | | X | X |
| 10 | | | | X | X | | | | X |

FLOW TO THE RIGHT HIGH VOLUME

| | | | | | | | | | |
|---|---|---|---|---|---|---|---|---|---|
| 1 | X | | | | | | X | X | |
| 2 | X | X | | | | | | X | X |
| 3 | | X | X | | | | | | X |
| 4 | | | X | X | | | | | |
| 5 | | | | X | X | | | | |
| 6 | | | | | X | X | | | |
| 7 | | | | | | X | X | | |
| 8 | X | | | | | | X | X | |
| 9 | X | X | | | | | | X | X |
| 10 | | X | X | | | | | | X |

FLOW TO THE RIGHT HIGHER VOLUME

FIG. 3

PERISTALTIC PUMP HAVING INFLATABLE PUMPING MEMBERS

BACKGROUND OF THE INVENTION

1. Field of the Invention

The present invention generally relates to fluid pumps of the type in which a flexible tube is progressively distorted in order to produce a pumping action; that is, it relates to peristaltic pumps. More particularly, it relates to a novel pump of the peristaltic type which provides improved operating versatility, reliability, and life.

2. Description of the Prior Art

Peristaltic pumps are designed so that a hose or tube containing a fluid to be conveyed is sequentially squeezed by a series of mechanical fingers or cam surfaces arranged along a section of hose or tube. The following patents show prior art designs.

U.S. Pat. No. 2,877,714 to Sorg et al. shows a variable displacement tubing pump. FIGS. 6 and 7 show the tubing being pressed against itself for peristaltic pumping.

U.S. Pat. No. 3,427,986 to Corneil shows a fluid pump with controlled variable flow. FIG. 7 shows distortion of the tube against itself. Provision is made for regulating the degree of distortion in order to control the flow.

U.S. Pat. No. 3,609,069 to Martinelli shows a peristaltic pump for conveying liquids in a chemical apparatus. The drawing figure shows a series of plungers for squeezing the hose 2 against a bed 3 to move the liquid.

U.S. Pat. No. 3,981,633 to Wall shows a pump having a cylindrical tube within the hose. Progression of the fluid is achieved by a wave-like motion imparted on the hose. FIGS. 4*a* and 4*b* show the hose being pressed against the cylinder but not against itself.

U.S. Pat. No. 4,199,307 to Tassawalla shows a medical infusion pump which uses plungers that press against sleeve portions.

U.S. Pat. No. 4,302,164 to Manella shows a peristaltic pump which compresses the tube in two directions. FIG. 4 shows the hose flattened horizontally and then flattened vertically.

U.S. Pat. No. 4,373,525 to Kobayashi shows the use of a sensor to monitor the internal pressure of the fluid-infusion tube. Monitoring the internal pressure can serve to detect an occluding particle.

U.S. Pat. No. 4,561,830 to Bradley shows a linear peristaltic pump which uses cam actuated fingers to squeeze the fluid tube.

U.S. Pat. No. 4,671,792 to Bosanyi shows a pressure regulating peristaltic pump wherein a moveable platen positioned on a compression pad can be regulated in order to control fluid pressure at the outlet end of the hose.

U.S. Pat. No. 4,725,205 to Cannon et al. shows a peristaltic pump with cam action compensation that limits the force the peristaltic mechanism can exert against the tube.

U.S. Pat. No. 4,781,548 to Alderson shows an infusion pump with a conduit integral with a sturdier section.

It will be appreciated that the use of fingers or cam surfaces in prior art peristaltic pumps tend to stress the tube so that the pumps have a short operating life. Further, these prior designs are not well suited for use with a variety of pumped materials, such as for example slurries and other "lumpy" materials. Finally, these prior art peristaltic pumps are not readily adaptable to provide a range of volume-pressure outputs or reversible flow operation, or mixing applications.

SUMMARY OF THE INVENTION

It is therefore an object of the present invention to provide a novel and improved actuating mechanism for providing peristaltic pumping; one that does not overstress a tube and one that allows operation with a variety of materials and a variety of pressure-volume conditions.

Briefly, this invention contemplates the provision of a peristaltic pump in which a series of inflatable members serve to sequentially restrict a fluid passage in order to provide the pumping action. The fluid passageway is a closed passage as for example a tube. However in certain applications the principles of this invention may be applicable to an open passage such as a trough. In one embodiment, a series of inflatable toroidal members are mounted on a tube that has a flexible wall. When sequentially inflated, the toroidal members sequentially squeeze the wall into engagement with a centrally disposed mandrel, thusly, providing a peristaltic pumping action. In another embodiment, the inflatable members are chambers disposed inside the tube and, when sequentially inflated, sequentially restrict the passage through the tube. In yet another embodiment of the invention, the wall of the tube itself is comprised of a series of inflatable members which, when sequentially inflated, sequentially restrict the passageway there through.

BRIEF DESCRIPTION OF THE DRAWINGS

The foregoing and other objects, aspects and advantages will be better understood from the following detailed description of a preferred embodiment of the invention with reference to the drawings, in which:

FIG. 3 is a series of charts showing exemplary sequential inflation patterns to achieve various operating results.

DETAILED DESCRIPTION OF A PREFERRED EMBODIMENT OF THE INVENTION

Figure 1A:
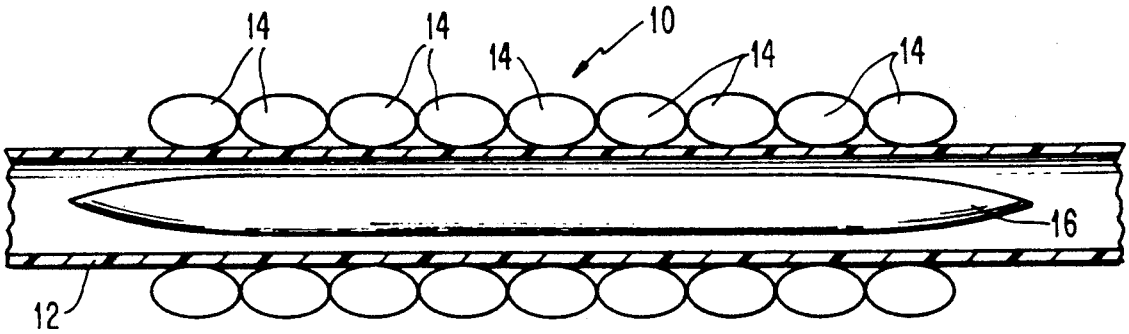
FIG. 1*a* and 1*b* are schematic views of one embodiment of the invention, respectively side sectional and cross sectional views.
Figure 1B:
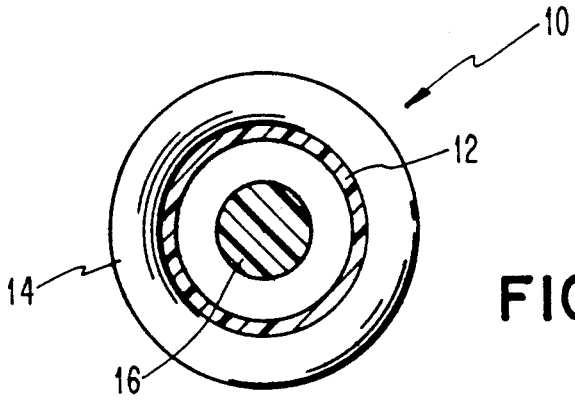

Referring now to the drawings, and more particularly to FIGS. 1*a*–1*b*, a peristaltic pump indicated by the general reference number 10 is comprised of a length of tube with a flexible wall 12. A plurality (nine in this example) of toroidal shaped, inflatable pump members 14 are mounted along the tube. Each of the members 14 is preferably radially elastic, so that when inflated, the member exerts a force on the wall of the tube in the region where the member is mounted, squeezing the tube in that region until the interior surface of the tube wall in the region contacts a centrally disposed mandrel 16, thereby blocking or impeding the passage through the tube. The mandrel 16 may be either rigid or flexible, depending on the pumping application. While nine inflatable members are shown in this exemplary embodiment, it will be appreciated that more or fewer members may be used, again depending on a particular application. As in prior art peristaltic pumps, sequential squeezing of the tube creates the pumping action. In accordance with this invention, sequential inflation and deflation of the inflatable members 14, squeeze the tube 12 and thus produces a peristaltic pumping action. By proper sequencing, the pump will pump in either direction. Inflating two or more members at the same time in the sequence increases the back pressures at which the pump can operate.

Figure 2:
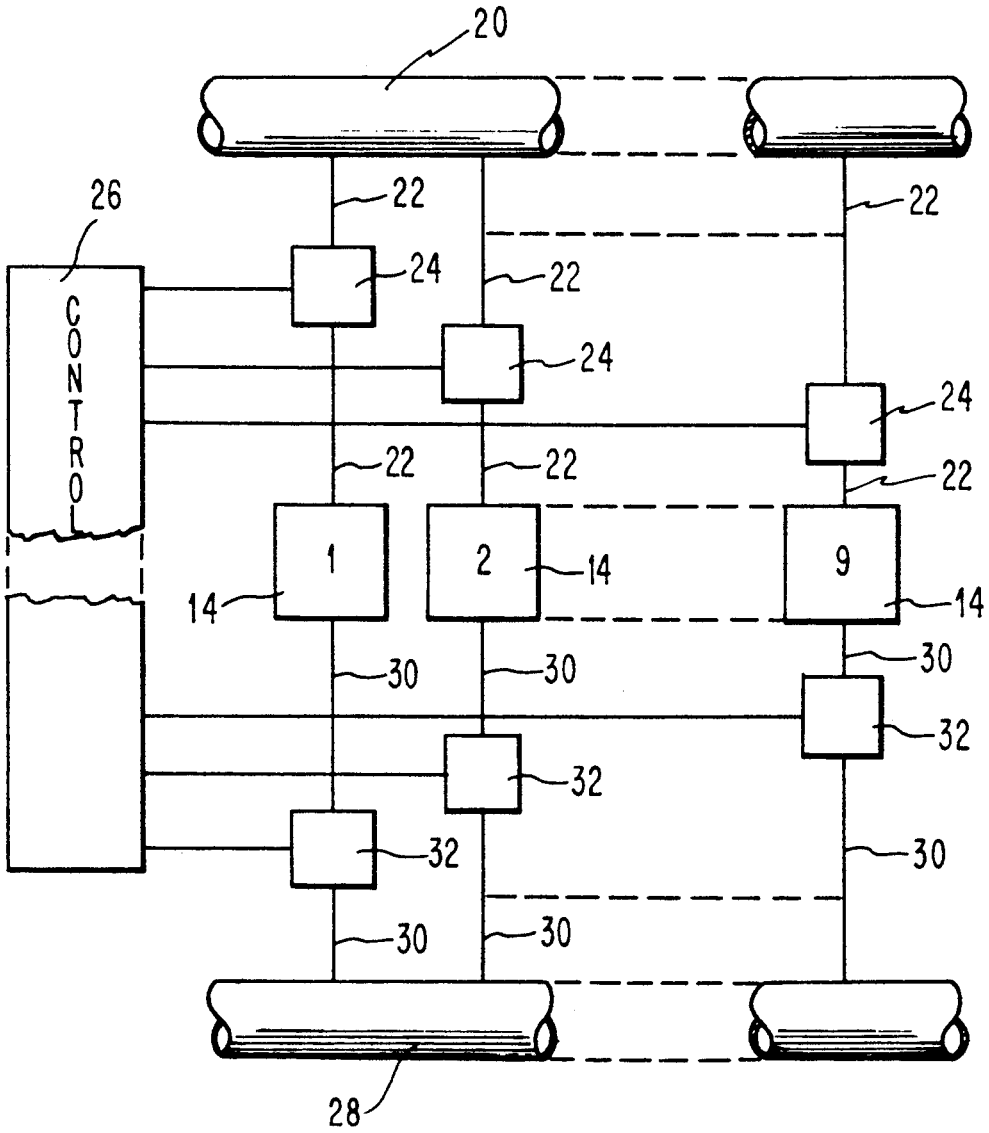
FIG. 2 is a schematic drawing of a system for inflating and deflating the inflatable members in accordance with the teachings of this invention.

Referring now to FIG. 2, it shows schematically one of a number of suitable systems for inflating and deflating the inflatable members. The members may be inflated either hydraulically or pneumatically. A header 20 supplies hydraulic or pneumatic fluid under pressure to each of the members 14 via individual supply leads 22 and solenoid control valves 24. A suitable controller 26, such as a microprocessor based controller, energizes the valves 24 in a desired sequence in order to achieve a desired pumping action. Preferably, each member 14 is also connected to a low pressure header 28 by a lead 30 and solenoid control valve 32 in order to assist in expelling fluid from the member 14 upon deflation. Controller 26 may be used to control valves 32 in addition to valves 24.

Referring now to FIG. 3, it shows typical sequencing patterns for a nine membered pump, such as that shown in FIG. 1. The time sequential steps for a repetitive pattern are indicated vertically in each chart in the Figure, and the member number is indicated horizontally. An "x" indicates the member is inflated. It should be noted that in the preferred embodiment of the invention, adjacent members are inflated in pairs throughout the sequence and that the flow volume is increased by increasing the spacing between adjacent inflated members or member pairs. Increasing the number of adjacent members energized increase the back pressure at which the pump can operate.

Figure 4:
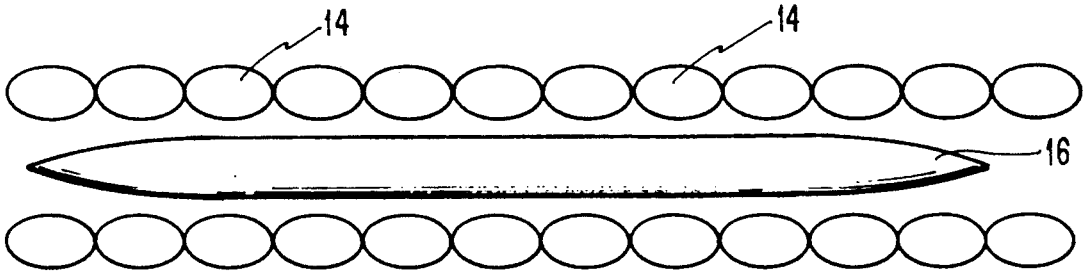
FIGS. 4; 5*a*–5*b* and 6*a*–6*b* are views similar to FIGS. 1*a*–1*b* of three alternate embodiments of the invention.

Referring now to FIG. 4, this embodiment of the invention is similar to that shown in FIG. 1. Here, however, the inner surface of the inflatable toroidal members 14 form the wall of the passageway, eliminating the need for a separate, flexible wall tube. The operation of this embodiment is essentially the same as that described in connection with FIG. 1.

Figure 5A:
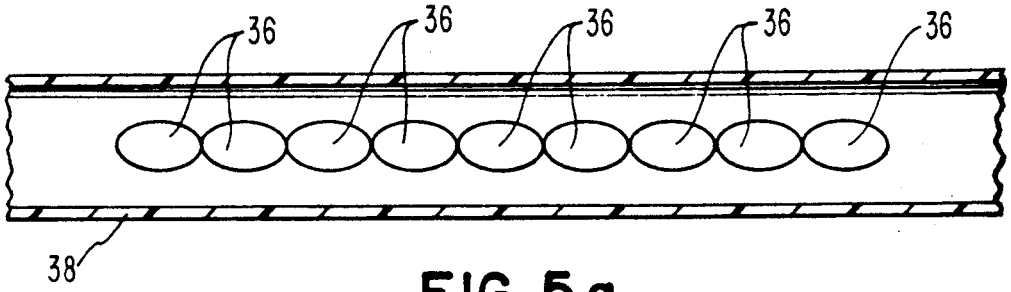
Figure 5B:
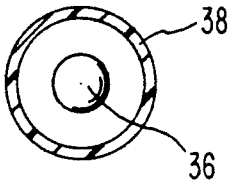

In the embodiment of the invention shown in FIGS. 5*a*–5*b*, a series of inflatable members 36 are disposed inside a section of tubing 38, which may have a rigid wall if desired. Here, when the flexible inflatable members 36 are inflated they expand to contact the inside wall of the tube, obstructing the passageway through the tube. The sequencing of inflation of the inflatable members may be in accordance with the principles of peristaltic pumping well understood in the art and described in connection with FIGS. 1, 2 and 3.

Figure 6A:
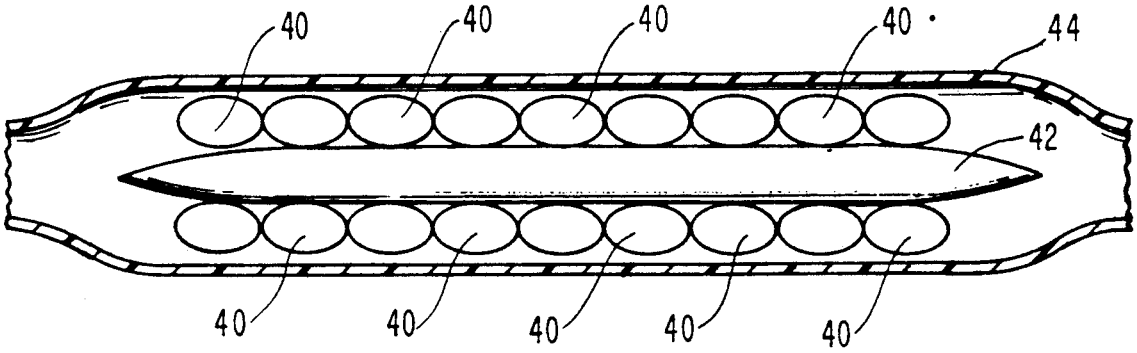
Figure 6B:
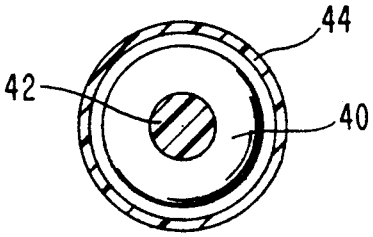

The embodiment of the invention shown in FIGS. 6*a*–6*b* has a series of toroidal inflatable members 40 mounted on a mandrel 42 disposed inside a tube 44 which, if desired, may have a rigid wall. Inflation of each member 40 causes it to expand and engage the interior wall of the tube, blocking the passage in that region. The principles of sequencing for this embodiment are the same as those for the embodiments already described.

While the invention has been described in terms of a single preferred embodiment, those skilled in the art will recognize that the invention can be practiced with modification within the spirit and scope of the appended claims. For example, it will be appreciated that sequencing of the inflatable members is completely controllable. Thus, for a mixing application, members may be deflated to admit material from one end of a tube. Those members may then be inflated, and members at other end deflated to admit a second material to be mixed with the first. Intermediate members may then be inflated to assist in a mixing action, and when completed the resultant product can be discharged through a peristaltic pumping action as heretofore described.

Having thus described my invention, what I claim as new and desire to secure by Letters patent is as follows:

1. A peristaltic pump comprising in combination;

a passageway, a plurality of discrete, inflatable members forming said passage, and means to inflate said members in a repetitive sequence that produces a peristaltic pumping action by sequentially blocking and unblocking regions of said passage.

2. A peristaltic pump comprising in combination;

a tube with an elastic deformable wall, said wall having an outer surface and an inner surface;

a plurality of inflatable toroidal members mounted on said outer surface of said tube wall;

a mandrel disposed inside said tube; and means to inflate said members in a repetitive sequence to cause said members to squeeze the inner surface of said wall into contact with said mandrel in a repetitive sequence that produces a peristaltic pumping act, by sequentially blocking and unblocking a passage through said tube.

* * * * *